US009843143B2

(12) United States Patent
Wu et al.

(10) Patent No.: US 9,843,143 B2
(45) Date of Patent: Dec. 12, 2017

(54) CABLE CONNECTOR ASSEMBLY HAVING IMPROVED WIRE SPACER

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 150 days.

(21) Appl. No.: 14/864,907

(22) Filed: Sep. 25, 2015

(65) Prior Publication Data

US 2016/0093987 A1 Mar. 31, 2016

(30) Foreign Application Priority Data

Sep. 25, 2014 (CN) ..... 2014 2 0554471 U

(51) Int. Cl.
*H01R 13/66* (2006.01)
*H01R 13/72* (2006.01)

(52) U.S. Cl.
CPC ..... *H01R 13/665* (2013.01); *H01R 13/72* (2013.01)

(58) Field of Classification Search
CPC ..... H01R 13/72; H01R 13/665
See application file for complete search history.

(56) References Cited

U.S. PATENT DOCUMENTS 4,601,530 A * 7/1986 Coldren ..... H01R 24/62 439/460
5,190,472 A * 3/1993 Voltz ..... H01R 13/6589 439/579
5,222,898 A * 6/1993 Fedder ..... H01R 13/6597 439/101
5,363,539 A * 11/1994 Tisol ..... F16L 3/2235 24/339
5,566,268 A * 10/1996 Radliff ..... G02B 6/4471 385/114
6,080,007 A * 6/2000 Dupuis ..... H01R 13/6467 439/418
6,483,980 B1 * 11/2002 Wu ..... G02B 6/2938 385/137
6,498,506 B1 * 12/2002 Beckous ..... G01R 1/06772 324/538
6,506,077 B2 * 1/2003 Nagel ..... H01R 13/6474 439/418
6,802,744 B2 * 10/2004 Chiang ..... H01R 4/023 439/701
7,147,512 B2 * 12/2006 Wu ..... H01R 12/721 439/607.05

(Continued)

*Primary Examiner* — Briggitte R Hammond
(74) *Attorney, Agent, or Firm* — Wei Te Chung; Ming Chieh Chang

(57) ABSTRACT

A cable connector assembly comprises a cable including a number of wires, and an electrical connector including a spacer positioning the cable, the spacer defines a front face and a rear face, a number of through holes positioning the wires, and a respective midfellow formed between every two adjacent through holes, wherein a notch is defined on the midfellows in the rear face to make the through holes in fluid communication.

19 Claims, 12 Drawing Sheets

(56) References Cited

U.S. PATENT DOCUMENTS

| | | | | |
|---|---|---|---|---|
| 7,270,571 | B1 * | 9/2007 | Huang | H01R 4/023 439/607.45 |
| 7,435,132 | B1 * | 10/2008 | Fong | H01R 9/038 439/497 |
| 7,556,536 | B2 * | 7/2009 | Caveney | H01R 13/514 439/676 |
| 7,758,374 | B2 | 7/2010 | Yu et al. | |
| 7,938,675 | B1 * | 5/2011 | Yu | H01R 12/724 439/485 |
| 8,038,466 | B1 * | 10/2011 | Tai | H01R 12/7082 439/206 |
| 8,100,729 | B2 * | 1/2012 | Chen | H01R 9/03 439/719 |
| 8,133,071 | B2 | 3/2012 | Huang et al. | |
| 9,484,689 | B2 * | 11/2016 | Wu | H01R 43/28 |
| 2007/0293084 | A1 * | 12/2007 | Ngo | H01R 13/42 439/552 |
| 2009/0017684 | A1 * | 1/2009 | Lin | H01R 4/2433 439/607.41 |
| 2009/0223041 | A1 * | 9/2009 | Garrison | H01R 12/63 29/755 |
| 2010/0273347 | A1 * | 10/2010 | Tai | H01R 13/50 439/485 |
| 2011/0021059 | A1 * | 1/2011 | Lu | H01B 7/0892 439/345 |
| 2013/0164990 | A1 * | 6/2013 | Tsai | H01R 13/516 439/660 |
| 2014/0191457 | A1 * | 7/2014 | Sharma | H05K 3/301 269/37 |
| 2015/0044886 | A1 | 2/2015 | Little et al. | |
| 2015/0180170 | A1 * | 6/2015 | Yu | H01R 13/631 439/357 |
| 2015/0229041 | A1 * | 8/2015 | Lin | H01R 4/2433 439/404 |

* cited by examiner

CABLE CONNECTOR ASSEMBLY HAVING IMPROVED WIRE SPACER

BACKGROUND OF THE INVENTION

1. Field of the Invention

The present invention relates generally to a cable connector assembly, more particularly to an improved wire spacer or organizer thereof.

2. Description of Related Arts

U.S. Patent Application Publication No. 2015/0044886, published on Feb. 12, 2015, shows a cable connector assembly including a spacer. The spacer has a plurality of passageways extending through a front and rear surfaces thereof for receiving cable wires. The cable is further fixed by dispensing glues in the through holes.

With the separate and distinct passageways of the above spacer, a holding force of the cable wire to the passageway is not strong such that an inadvertent movement of the cable wire during manufacturing process may cause misaligned front ends of the cable, which impacts subsequent soldering process.

An improved wire spacer in a cable connector assembly is desired.

SUMMARY OF THE INVENTION

An object of the present invention is to provide an improved wire spacer in a cable connector for facilitating preparation of cable wires including a first type and a second type.

To achieve the above-mentioned object, a cable connector assembly comprises: a cable including a plurality of wires; and an electrical connector including a spacer positioning the cable, the spacer defining a front face and a rear face, a plurality of through holes positioning the wires, and a respective midfellow formed between every two adjacent through holes; wherein a notch is defined on the midfellow in the rear face to make the through holes in fluid communication.

DETAILED DESCRIPTION OF THE PREFERRED EMBODIMENT

Figure 1:
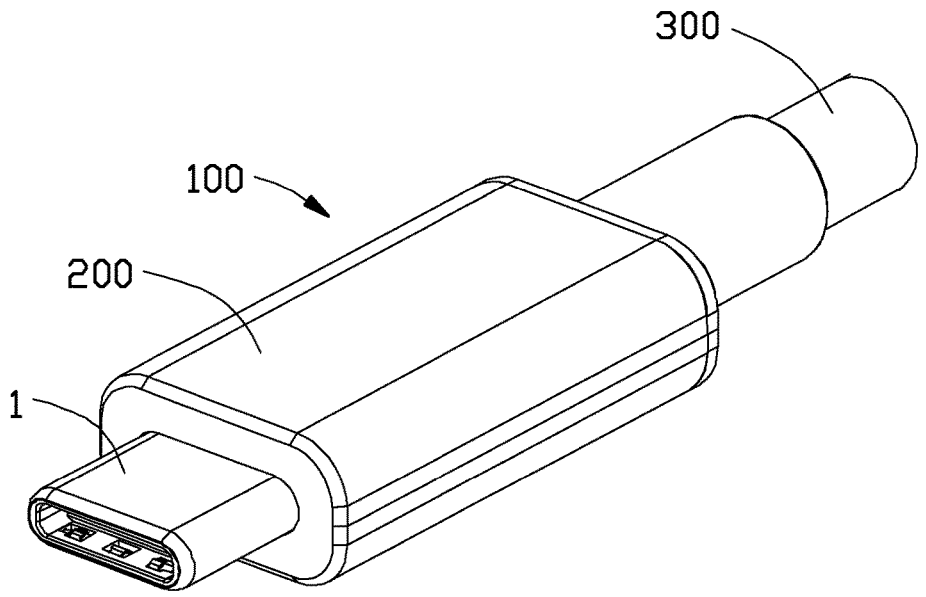
FIG. 1 is a perspective view of a cable connector assembly in accordance with the present invention.
Figure 2:
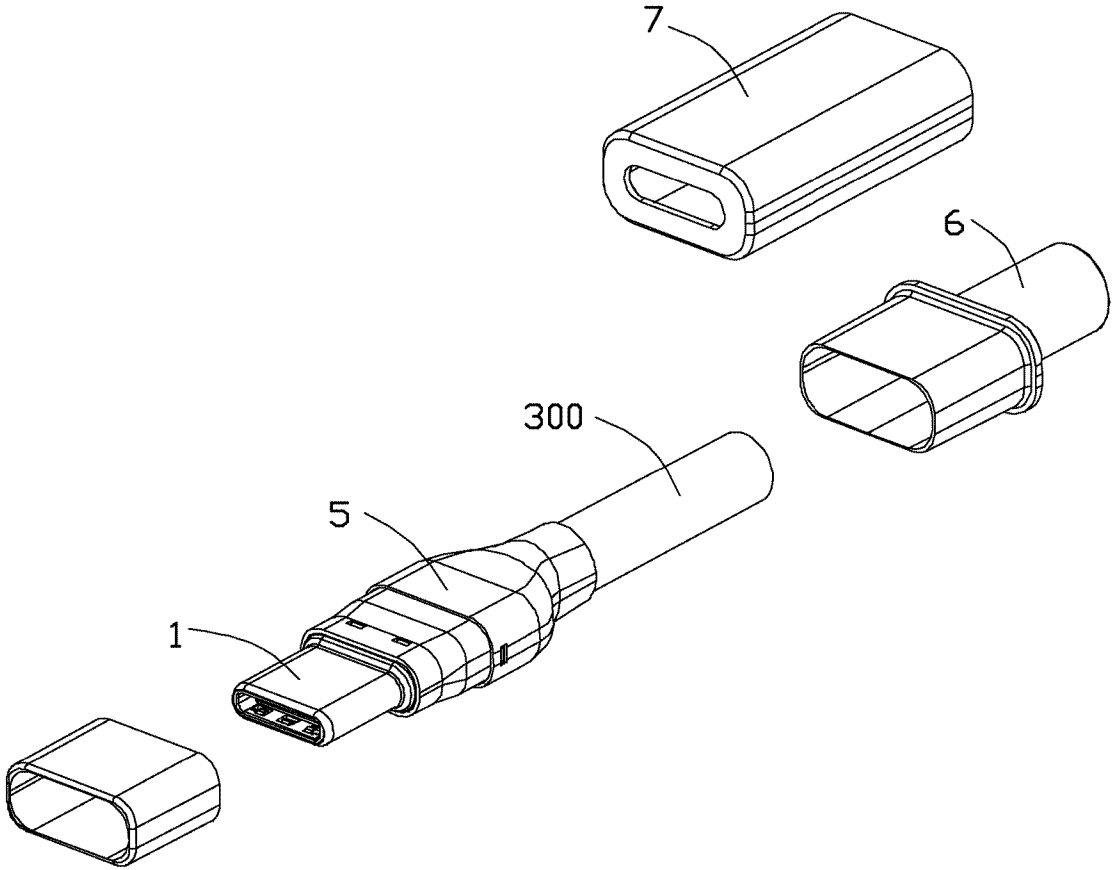
FIG. 2 is a partially exploded view of the cable connector assembly in FIG. 1.
Figure 3:
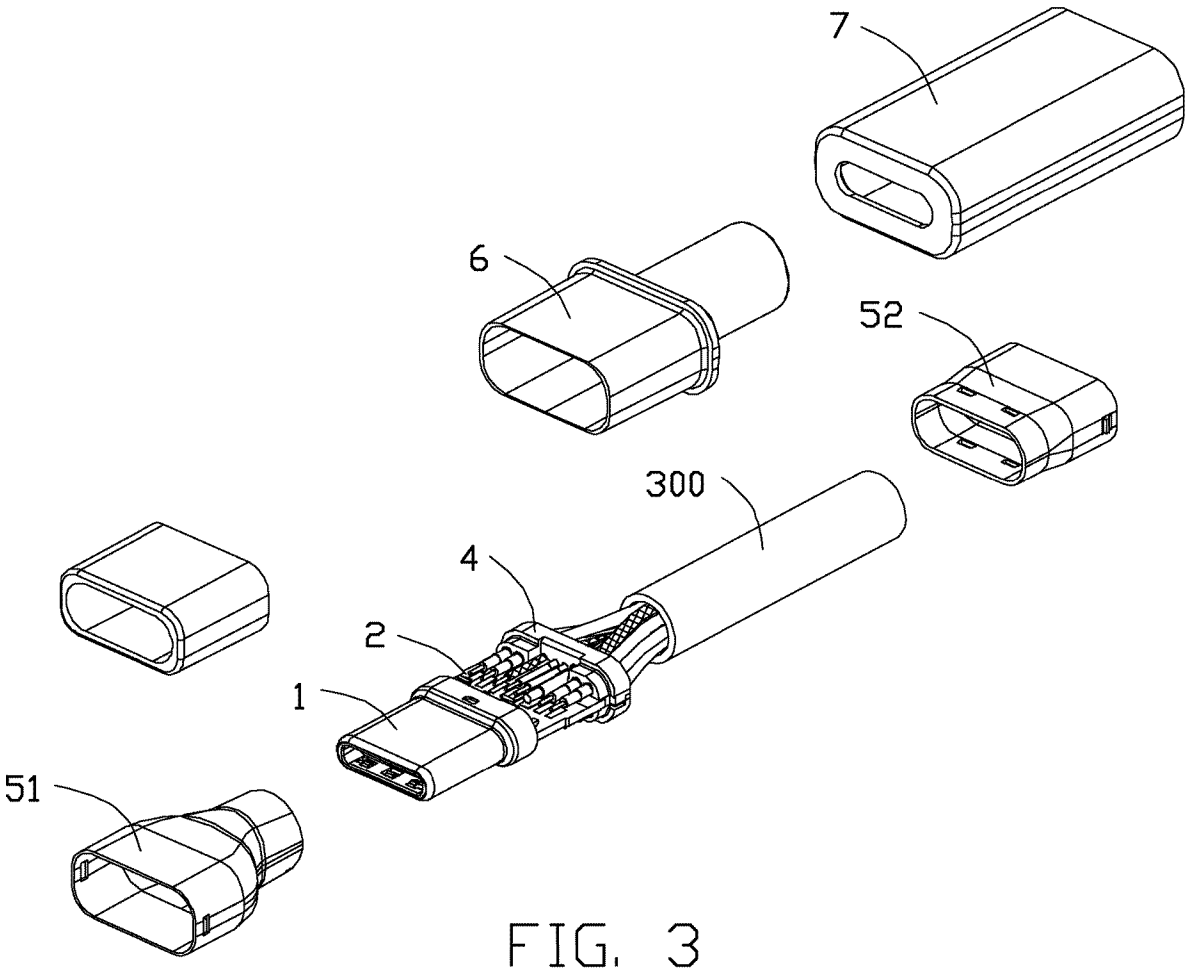
FIG. 3 is a further partially exploded view of the cable connector assembly in FIG. 1.

Referring to FIGS. 1 to 3, a cable connector assembly, e.g., a plug connector assembly 100, in accordance with the present invention for mating with a mating connector (not shown) comprises an electrical connector 200 and a cable 300 electrically connected to the electrical connector 200. The electrical connector 200 includes a mating member 1, an internal printed circuit board (PCB) 2 disposed behind and electrically connecting with the mating member 1, a wire organizer or spacer 4 for positioning the cable 300, an inner shell 5 cover on the mating member 1 and a conjugation segment of the cable 300, a strain relief 6 integrally molded on the inner shell 5 and the outer cable 300, and a outer shell 7 cover on the inner shell 5 and the strain relief 6. The plug connector assembly 100 can be mated with the mating connector in two orientations.

Figure 7:
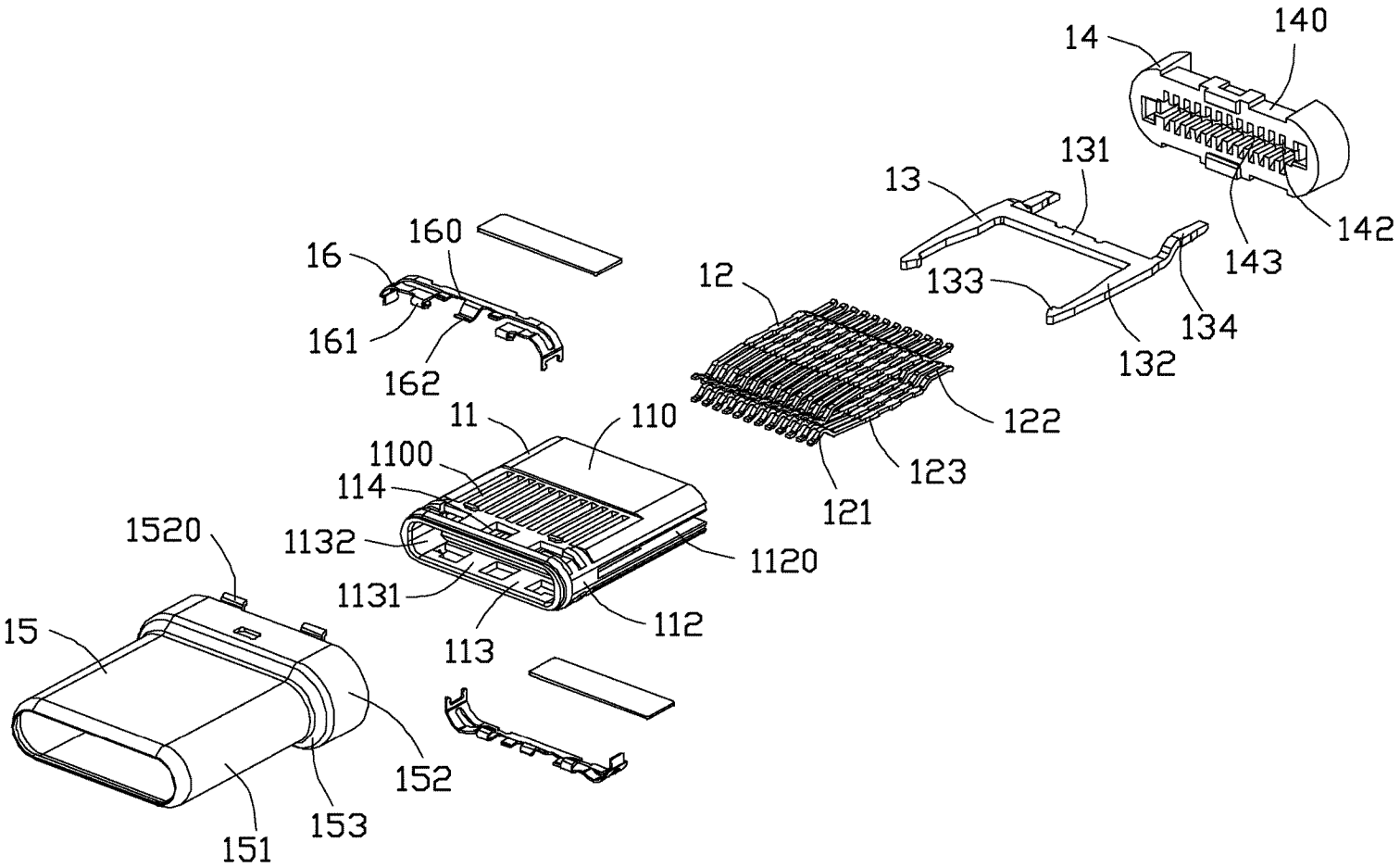
FIG. 7 is an exploded view of a mating member of the cable connector assembly in FIG. 1.
Figure 8:
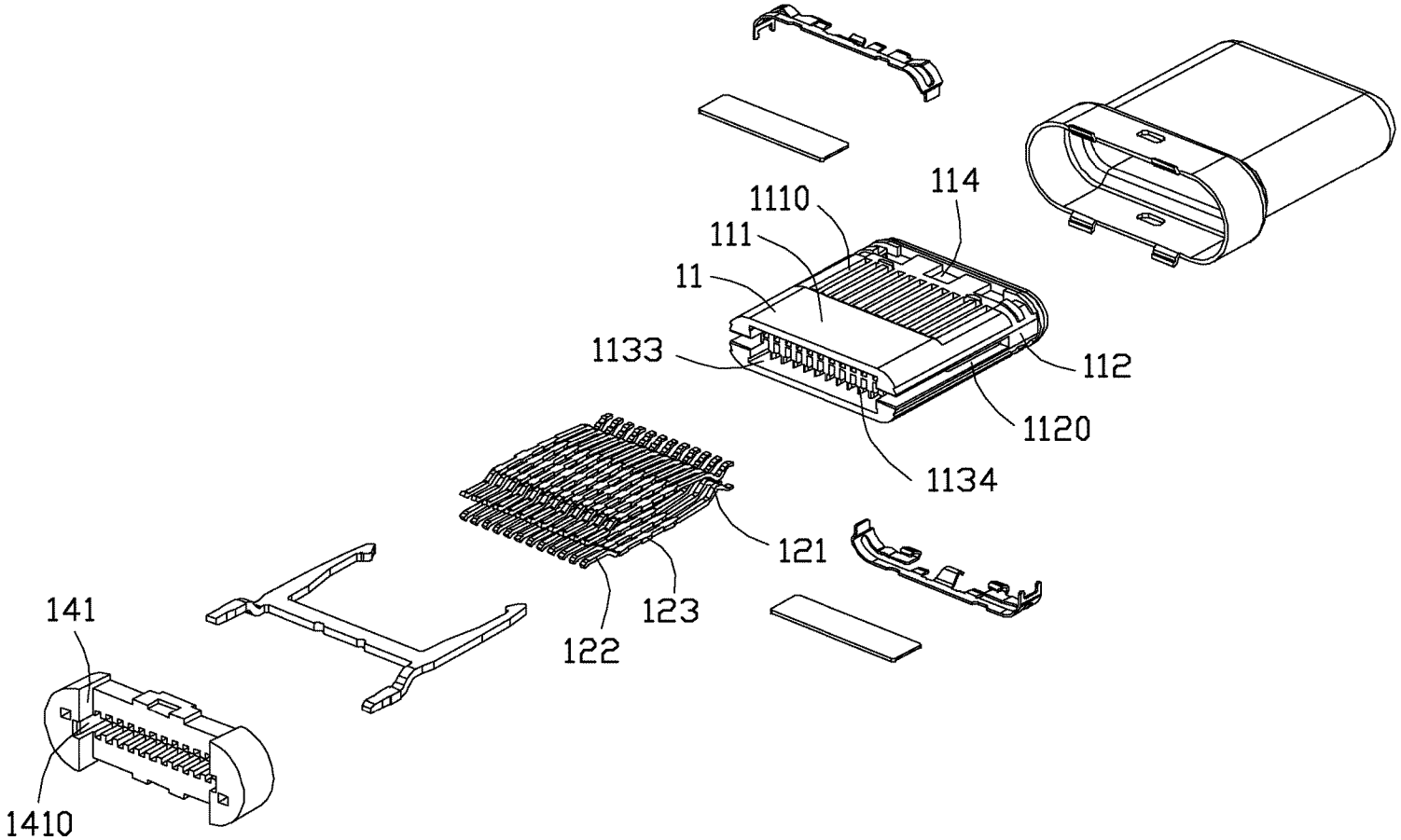
FIG. 8 is a view similar to FIG. 7, but from a different perspective.

Referring to FIGS. 7 and 8, the mating member 1 comprises an insulative housing 11, a plurality of first contacts 12 arranged in two rows and spaced apart from each other in a vertical direction, a latch 13 disposed between the two rows of contacts 12 for latching with the mating connector, an insulative member 14 disposed behind the insulative housing 11, a metal shell 15 covering the insulative housing 11 and the insulative member 14, and a pair of grounding members 16 disposed on the insulative housing 11.

The insulative housing 11 comprises a top wall 110, a bottom wall 111 spaced apart from and parallel with the top wall 110, a pair of side walls 112 connecting the top wall 110 and the bottom wall 111, a receiving room 113 surround by the top, bottom, and side walls 110, 111, 112, and the receiving room 113 is divided into a front portion 1132 having a front opening 1131, and a rear portion 1134 having a rear opening 1133. The top wall 110 defines a top recess 1100 in communication with the front portion 1132. The bottom wall 111 defines a bottom recess 1110 in communication with the front portion 1132. Each of the side walls 112 defines a side recess 1120 extending forwardly from a rear end of the insulative housing 11 but not through a front end of the insulative housing 11. The side recesses 1120 are in communication with the front portion 1132 and the rear portion 1134 of the receiving room 113. A number of slots 114 are defined on a front end of the top wall 110 and the bottom wall 111.

Each of the contacts 12 comprises a front mating portion 121 extending forwardly into the front portion 1132 of the receiving room 113, a rear mating portion 122 extending rearwardly, and an intermediate mounting portion 123 secured to the insulative housing 11. The front mating portion 121 is to be mated with the mating connector and the rear mating portion 122 is to be mated with the PCB 2. The front mating portions 121 of the two rows of contacts 12 are arranged face to face along the vertical direction.

The latch 13 comprises a base portion 131 extending along a transverse direction, a pair of latch beams 132 respectively extending forwardly from two opposite ends of the base portion 131, a latch portion 133 extending from a front end of each latch beam 132 along a face to face direction, and a pair of extension arms 134 respectively extending rearwardly from the two opposite ends of the base portion 131. An extension arm 134 on one side is in a lower plane relative to a plane that the base portion 131 located, and another extension arm 134 on the other side is in a higher plane relative to the plane that the base portion 131 located. The latch 13 is mounted into the insulative housing 11 through the rear opening 1133 of the rear portion 1134 of the receiving room 113. The base portion 131 abuts forwardly against the internal wall and the latch beams 132 are received into the side recesses 1120, respectively. At least a portion of each of the latch portions 133 projects into the front portion 1132 of the receiving room 113.

The insulative member 14 cooperates with the insulative housing 11 to fix the latch 13. The insulative member 14 comprises an insulative base portion 140, a pair of extending portions 141 extending rearwardly from two opposite ends of the base portion 140, two rows of through holes 142 spaced apart in the vertical direction and extending through the insulative base portion 140 along a front to rear direction, and a receiving groove 143 forms between the two rows of through holes 142. The receiving groove 143 is communicated with the through holes 142. Each of the extending portions 141 defines a mounting slot 1410 therethrough extending along a rear to front direction. The insulative member 14 is mounted to the insulative housing 11 along a rear to front direction. The contacts 12 are received in the two rows of the through holes 142. The base portion 131 of the latch 13 is received into the receiving groove 143, and the extension arm 134 is received in the corresponding mounting slot 1410. The rear mating portions 122 of the contacts 12 extend through the insulative member 140 through the through holes 142, respectively.

The metal shell 15 has a closed circumference that has a good seal performance, a good anti-EMI performance, etc. The closed circumference of the metal shell 15 could be manufactured by drawing a metal piece, bending a metal piece, die casting, etc. The metal shell 15 comprises a front end 151 for being inserted into the mating connector, a rear end 152 and a third transition portion 153 for connecting to the front end 151 and the rear end 152. The shape of the rear end 152 is consistent with the insulative member 14. A diametrical dimension of the front end 151 is smaller than a diametrical dimension of the rear end 152. The rear end 152 comprises a pair of latch tabs 1520 projecting outwardly.

One of the grounding members 16 is received into the top recess 1100, and the other one is received into the bottom recess 1110. Each of the grounding members 16 comprises a flat body portion 160, a pair of mounting portions 161 extending from two opposite ends of the flat body portion 160 and toward the insulative housing 11 for being attached to the insulative housing 11, a front grounding tabs 162 extending forwardly from a front side of the flat body portion 160 and entering into the front portion 1132 of the receiving room 113. The mounting portions 161 and the front grounding tabs 162 are received in the corresponding slots 114 of the top wall 110 and the bottom wall 111. The front grounding tabs 162 are used for mating with the mating connector. The front grounding tabs 162 of the pair grounding members 16 are disposed face to face along the vertical direction. A distance along the vertical direction between the front grounding tabs 162 of the pair of grounding members 16 is greater than a distance along the vertical direction of the front mating portions 121 of the two rows of contacts 12.

Figure 4:
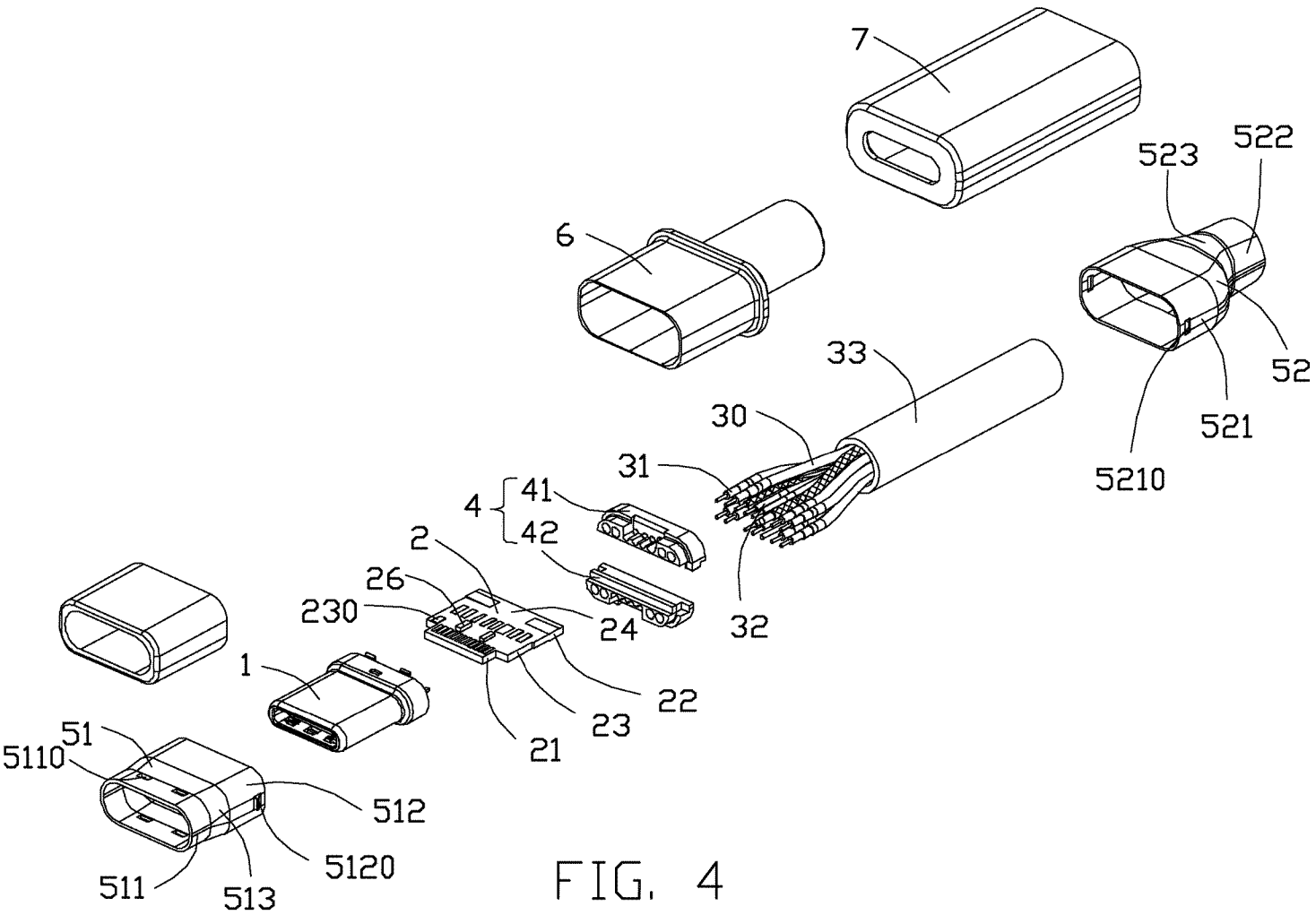
FIG. 4 is an exploded view of the cable connector assembly in FIG. 1, but not including the mating member.
Figure 5:
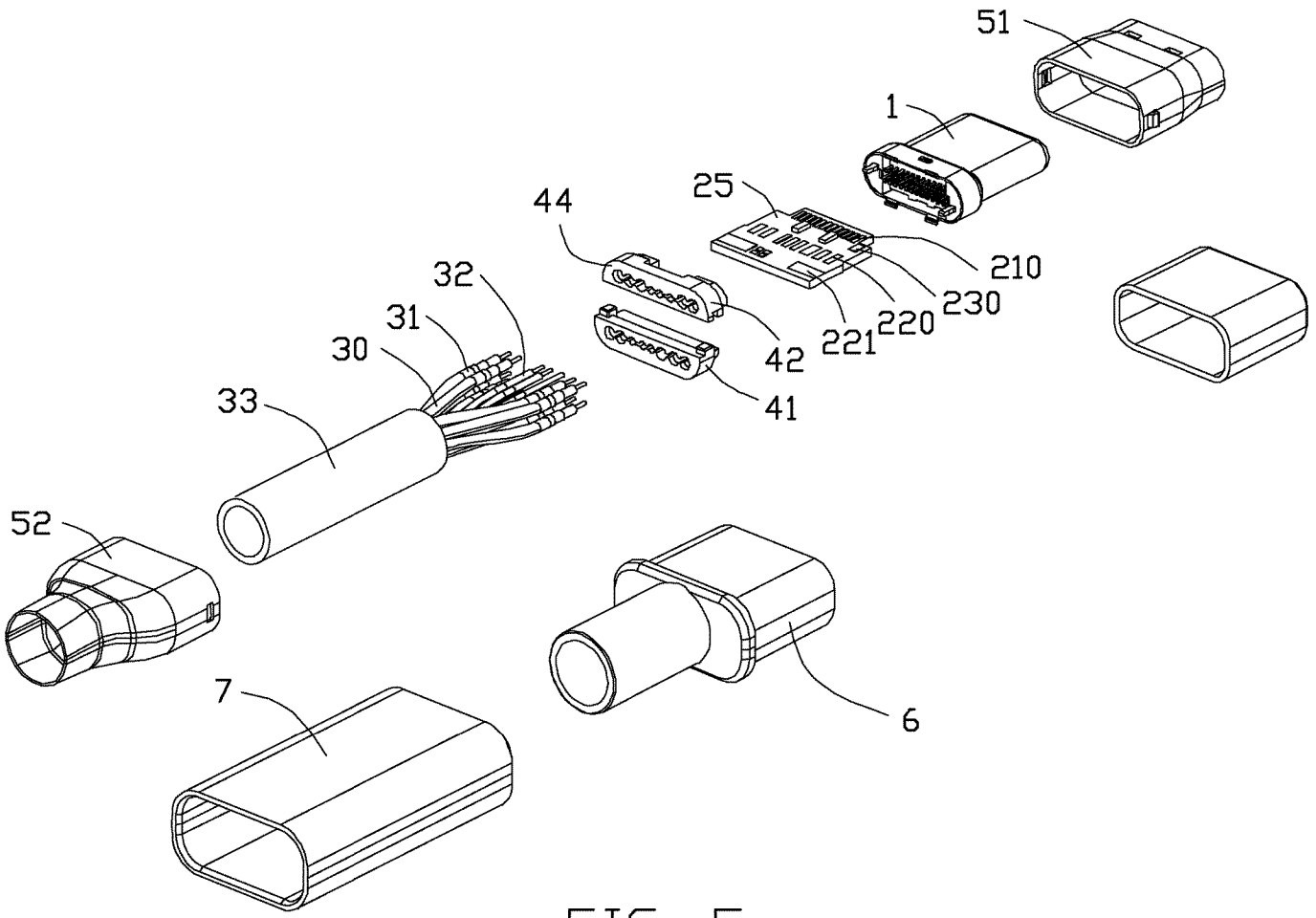
FIG. 5 is a partially exploded view of the cable connector assembly in FIG. 4, not including the mating member, but from a different perspective.

Referring to FIGS. 4-5, the PCB 2 is disposed between the mating member 1 and the cable 3. The cable 300 is electrically connected with the contacts 12 by the PCB 2. The PCB 2 comprises a front portion 21, a rear portion 22, and a middle portion 23 connecting the front portion 21 and a rear portion 22. The PCB 2 defines a top side 24 and a bottom side 25 opposite to the top side 24. A number of first conductive pads 210 are formed on both of the top side 24 and the bottom side 25 of the front portion 21, and electrically connected to the rear mating portions 122 of the contacts 12. A plurality of second conductive pads 220 are formed on both of the top side 24 and the bottom side 25 of the rear portion 22, and electrically connected with a number of wires 30 of the cable 300. A number of third conductive pads 221 are formed on a side of the second conductive pads 220 away from the first conductive pads 210. The width of front portion 21 is smaller than the rear portion 22 along a transverse direction. The distance between the adjacent first conductive pads 210 is smaller than the adjacent second conductive pads 220. The width of the first conductive pads 210 is greater than the second conductive pads 220. The number of the first conductive pads 210 is greater than the second conductive pads 220. A metal pad 230 is formed on both of the top side 24 and the bottom side 25 of the middle portion 23 for electrically connected with the corresponding extension arms 134 of the latch 13 to strengthen the fixation of the latch 13. The PCB 2 is mounted to the insulative member 14 by the front portion 21 along the mounting slots 1410. The front portion 21 of the PCB 2 is disposed between the rear mating portions 122 of the two rows of contacts 12. The rear mating portions 122 are electrically connected with the corresponding first conductive pads 210. A number of electrical components 26 are set on the PCB 2.

Figure 6:
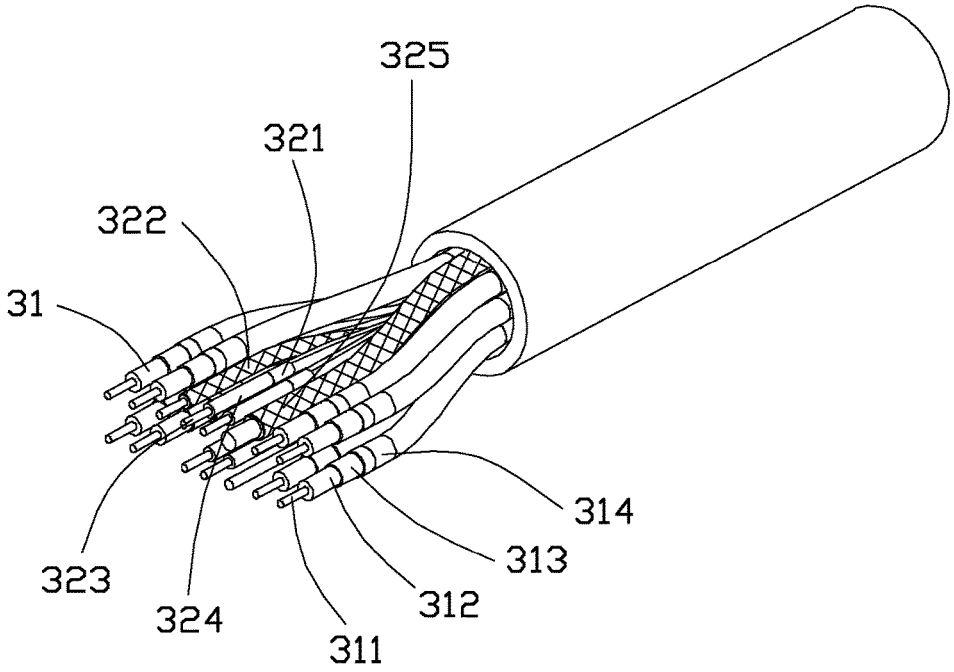
FIG. 6 is a perspective view of the cable of the cable connector assembly in FIG. 1.
Figure 11:
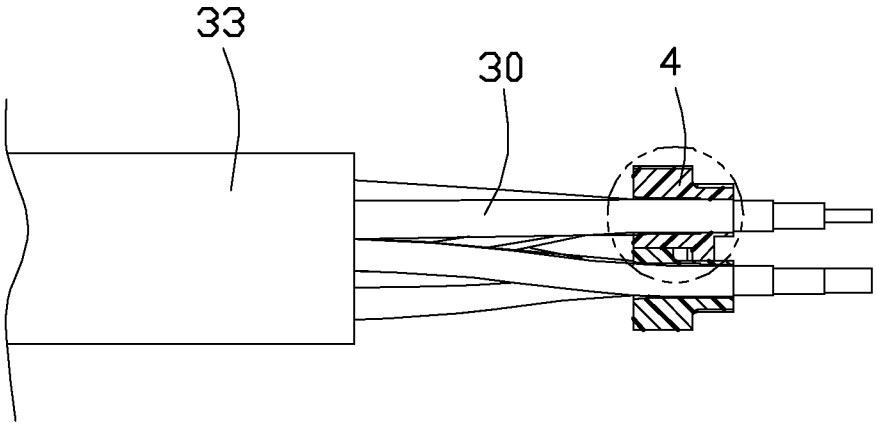
FIG. 11 is a schematic cross-sectional view of the cable assembled to the fixing member.
Figure 12:
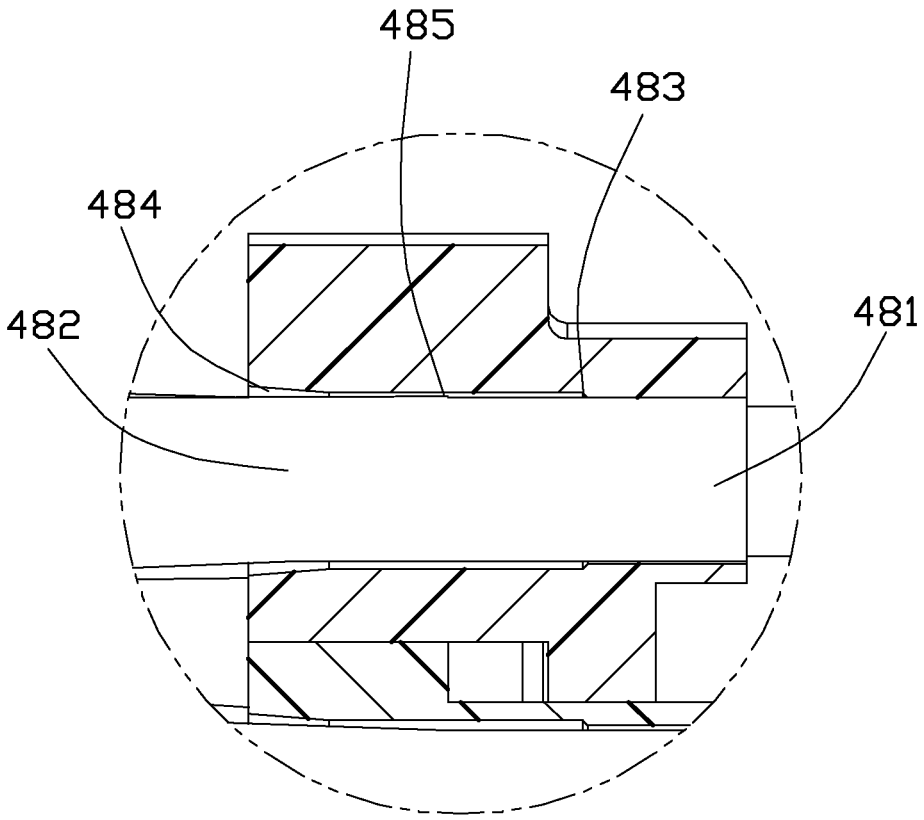
FIG. 12 is a enlarge view of the dotted line portion in FIG. 11.

Referring particularly to FIG. 6 and FIG. 11, the cable 300 has a number of wires 30 and a sheath 33 that contains the wires 30, e.g., two types of wires. Each wire 30 comprises a number of the first type of wires 31 and a number of second type of wires 32. A number of the first type of wires 31 are set on at least one side of the PCB 2, and a number of the second type of wires 32 are arranged adjacent to the first type of wires 31. Each of the first type of wire 31 includes a first inner dielectric 311, a inner jacket 312 covering the first inner dielectrics 311, a braiding 313 covering the inner jacket 312 and a outer jacket 314 covering on the braiding 313. The braiding 313 are electrically connected with the third conductive pads 221. The second type of wires 32 includes a first wire 321 and a second wire 322. Both of the first wire 321 and the second wire 322 includes a second inner dielectrics 323, a first jacket 324 covering on the second inner dielectrics 323. The second wire 322 further includes a second jacket 325 covering the first jacket 324. The first jacket 324 of the second wire 322 is used to prevent burns of the second wire 322 when welding the braiding 313. The first jacket 324 is made of Teflon insulation material which has a higher temperature resistance, that prevents a short circuit occurs when weld the braiding 313 to the third conductive pads 221, although touching the first jacket 324. The second jacket 325 is made of PET material which has a good adhesiveness, and difficult to shift after being fixed using glue. The first jacket 324 of the first wire 321 can be made of PET material or some other material has a good adhesiveness for making itself more firmly fixed by glue. In this embodiment, only the second type of wires 32 adjacent the first type of wires 31 on the top side 24 of the PCB 2 includes the second jacket 325. A bare ground wire defining on the bottom side 25 is set on a side of the first type of wire 31, while the other side of the first type of wire 31 is vacant, so it is unnecessary to use the second type of wires 32 having the second jacket 325. In other embodiments, the second type of wires 32 can be set adjacent to the first type of wires 31 on the top side 24 and the bottom side 25 according to need. The second type of wires 32 are set on inside position of the PCB 2, and the first type of wires 31 are set on both sides of the second type of wires 32. In this embodiment, the number of the second type of wires 32 is seven, and the number of the first type of wires 31 is eight. In other embodiments, the first type of wires 31 and the second type of wires 32 can be provided in a different quantity according to needs.

Figure 9:
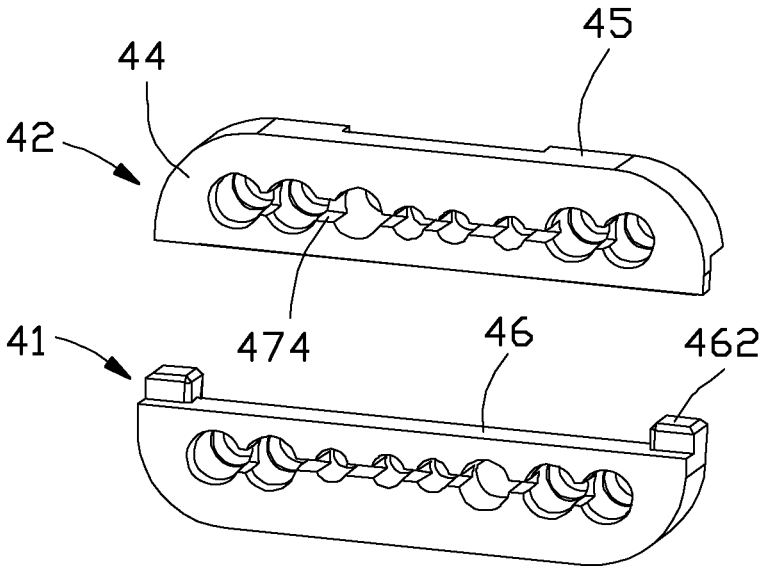
FIG. 9 is a perspective view of the fixing member of the cable connector assembly in FIG. 1.
Figure 10:
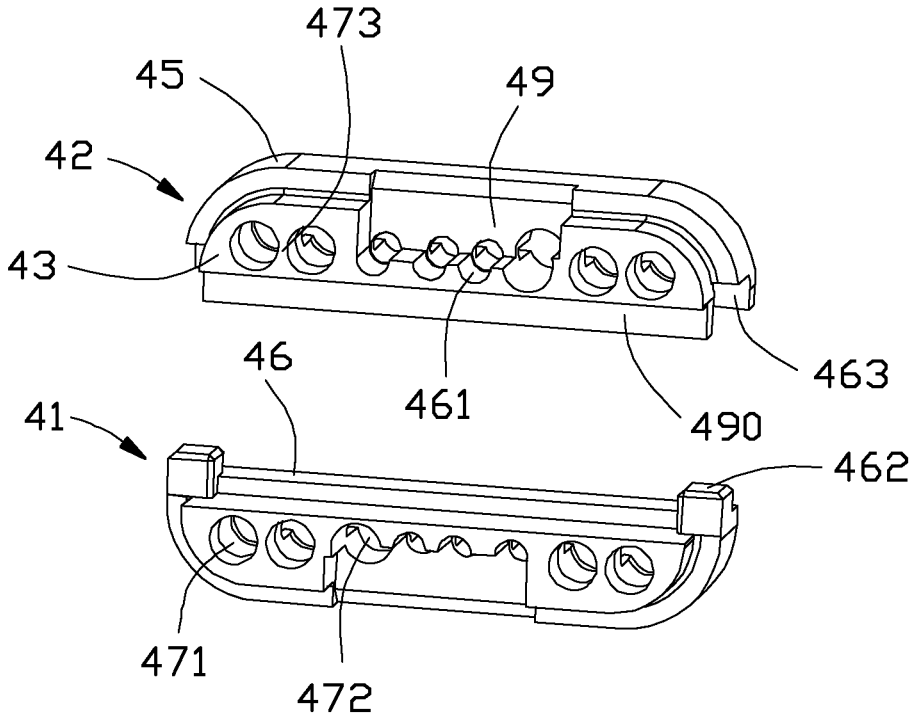
FIG. 10 is a view similar to FIG. 9, but from a different perspective.

Referring also to FIG. 9 and FIG. 10, the spacer 4 according to present embodiment has two pieces, and in other embodiment, the spacer 4 can be one-piece. The spacer 4 in present embodiment comprises an upper half 41 and a lower half 42 cooperated with the upper half 41. A part of the wires of the first and second types are positioned on the top side 24 of the PCB 2 by the upper half 41, and the other parts of the wires of the first and second types are positioned on the bottom side 25 of the PCB 2 by the lower half 42. Each spacer half has a front face 43 close to the PCB 2, an opposite rear face 44, a top face 45, a bottom face 46, a plurality of first through holes 471 for positing the first type of wires 31, a plurality of second through holes 472 for positing the second type of wires 32, and a plurality of midfellows or partitions 473 formed between the through holes. The midfellows 473 extend from the front face 43 to the rear face 44. A notch 474 is defined on each of the midfellows 473 and extended from the rear face 44 along a rear to front direction but not through the front face 43, to make the adjacent through holes in fluid communication. The wires 31 are posited in the corresponding through holes by pointing the glue into the through holes and letting the glue flow among the wires 30 through the notch 474. The adhesion area of glue in the through holes increases, thereby increasing the holding force. The notch 474 extends forwardly but not through the front face 43, which ensures the strength of the spacer 4 not reduced. Each of the first through holes 471 and the second through holes 472 includes a front portion 481 close to the front face 43, a rear portion 482 close to the rear face 44, and a middle portion 483 connecting the front portion 481 and the rear portion 482. The diameter of the front portion 481 is smaller than the middle portion 483, and the diameter of the middle portion 483 is smaller than the rear portion 482. That makes the glue in the through holes easy to flow and diffuse. The rear portion 482 includes a first portion 484 close to the rear face 44 and a second portion 485 connecting with the middle portion 483. The diameter of the first portion 484 is decreasing along a rear to front direction for facilitating glue penetration. An avoiding portion 49 communicating with the second through holes 472 is defined on each spacer half through the front face 43 and the top face 45. The second type of wires 32 can be received in the avoiding portion 49 when the first type of wire 31 is handling to avoiding accidental injury. The second type of wires 32 extending from the second through holes 472 are connected with the PCB 2. A recess of the avoiding portion 49 defines a number of limiting groove 461 to limit the horizontal movement of the wires 32 of second type. A respective step 490 is formed on each spacer half for engaging with a rear edge of the PCB 2. A pair of posts 462 formed on the first half 41 or the second half 42 are extended from the two opposite end of the bottom face 46, and the another of the spacer half defines a pair of receiving slots 463 to receive the corresponding posts 462.

Referring particularly to FIG. 3, the inner shell 5 includes a first shell 51 and a second shell 52. The first shell 51 has a closed circumference that has a good seal performance, a good anti-EMI performance, etc. The closed circumference of the first shell 51 could be manufactured by drawing a metal piece, bending and forming a metal piece, die casting, etc. The first shell 51 comprises a first front end 511 telescoped with a rear end of the mating member 1, a first rear end 512 opposite to the first front end 511, and a first transition portion 513 between the first front and rear ends 511 and 512. The first front end 511 is larger than the first rear end 512. The first front end 511 defines a pair of latch holes 5110 latched with the latch tabs 1520 of the metal shell 15, when the first shell 51 is telescoped on an outer side of the rear end 152 of the metal shell 15. A block 5120 is defined on each opposite side of the first rear end 512. The first front end 511 of the first shell 51 is interference fit with the rear end 152 of the metal shell 15. The first front end 511 of first shell 51 and the rear end 152 of the metal shell 15 are further connected by laser welding in some spots or full circumference to have a good strength.

The second shell 52 has a closed circumference that has a good seal performance, a good anti-EMI performance, etc. The closed circumference of the second shell 52 could be manufactured by drawing a metal piece, bending and forming a metal piece, die casting, etc. The second shell 52 comprises a second front end 521 telescoped with the first rear end 512 of the first shell 51, a second rear end 522 telescoped and crimped with the cable 300, and a second transition portion 523 between the second front end 521 and the second rear end 522. The second front end 521 is larger than the second rear end 522. In assembling, firstly, the second shell 52 is telescoped on the cable 300. The second shell 52 is moved forwardly and telescoped on the spacer 4, after the wires 31 and 32 are soldered on the second conductive pads 220. A fixing hole 5210 are defined on the both side of the second front end 521. Then, the second shell 52 is forwardly moved beyond the spacer 4 to latch with the first rear end 512 of the first shell 51, and the block 5120 is received and fixed in the corresponding fixing hole 5210. Because of the second front end 521 is telescoped on the first rear end 512, the second front end 521 is larger, further avoiding the interference with the cable 300. Because of the second front end 521 is telescoped on the first rear end 512, the engagement of the first shell 51 and the second shell 52 is tightly, which achieves a good interference effect. The second front end 521 of second shell 52 and the first rear end 512 of the first shell 51 are further connected by spot laser welding or continuous welding to have a good strength. The second rear end 522 is telescoped on the cable 300 and riveted with the cable 300.

In assembling the cable connector assembly 100, firstly, the mating member 1 and the PCB 2 is provided, and the PCB 2 is assembled on the mating member 1. The extension arms 134 of the latch 13 are soldered with the third conductive pads 230. The cable 300 is provided. The cable 300 includes a number of first type and second type of wires. The times of processing the first type of wire 31 is more than the second type of wire 32. Each of the first type of wires 31 includes a first inner dielectric 311, a inner jacket 312 covering the first inner dielectric 311, a braiding 313 covering the inner jacket 312 and a outer jacket 314 covering on the braiding 313. The wires 32 of second type include first wires 321 and second wires 322. The spacer 4 defining a first half 41 and a second half 42 is provided. The first type of wires 31 are inserted into the first through holes 471, and the second type of wires 32 are inserted into the second through holes 472. The second type of wires 32 are arranged adjacent to the first type of wires 31. A portion of the cable 300 extending form the spacer 4 is securing by glue. Because of the outmost jacket of the second type of wires 32 is made of PET material with a good property of adhesion, the retaining force between the spacer 4 and the cable 300 is strong, and it is not easy to depart the cable 300 from the spacer 4 in assembly manufacturing process, and than, it avoids the length of inconsistencies when soldered effectively. The extended wires 32 of second type are bended rearwardly in the avoiding portion 49 to be out of way, i.e., not in the operation path of the first type of cable wires 31. In present embodiment, the method of processing the wires 30 is laser cutting, but in other embodiments, it also can be other methods. The step of operating the extended cable wires 31 of the first type may comprise removing an outer jacket 314 to exposing the braiding 313, and than removing the braiding 313 to exposing the inner jacket 312 thereof. The extended wires 32 of the second type is returned to its original state before bending and cut by the laser machine together with the first type of wires 31, to remove the inner jacket 312 of the wires 31 of the first type and the first and second jacket 324,325 of the second type of wires 32, as a result, the first inner dielectrics 311 of the first type of wires 31 and the second inner dielectrics 323 of the second type of wires 32 are exposed. Than the cable 300 are soldered on the PCB 2, the first inner dielectrics 311 of the first type of wires 31 are connected to the second conductive pads 220 on the top side 24, and the braiding 313 of the first type of wires 31 are connected to the third conductive pads 221. The first jacket 324 is made of Teflon, which avoids the short-circuited effectively. The second inner dielectrics 323 are connected to the corresponding second conductive pads 220 on the bottom side 25.

The inner shell 5 covers at least a portion of the mating member 1 and the cable 300.

The strain relief 6 is molded on at least a portion of the inner shell 5 and the cable 300. The outer shell 7 is molded or mounted on the inner shell 5 and the strain relief 6, and fixed use glue.

What is claimed is:

1. A cable connector assembly comprising:

a cable including a plurality of wires; and an electrical connector including a spacer positioning the cable, the spacer defining a front face and a rear face, a plurality of through holes positioning the wires, and a respective midfellow formed between every two adjacent through holes; wherein a notch is defined on the midfellows in the rear face to make the through holes in fluid communication.

2. The cable connector assembly as claimed in claim 1, wherein the notch extends forwardly but not through the front face.

3. The cable connector assembly as claimed in claim 2, wherein:

each through hole includes a front portion, a rear portion, and a middle portion; and a radial dimension of the front portion is smaller than a radial dimension of the middle portion, and the radial dimension of the middle portion is smaller than a radial dimension of the rear portion.

4. The cable connector assembly as claimed in claim 3, wherein the rear portion includes a first portion close to the rear portion and a second portion connecting with the middle portion.

5. The cable connector assembly as claimed in claim 4, wherein a radial dimension of the second portion is uniform along a forward direction, and a radial dimension of the first portion is decreasing along the forward direction.

6. The cable connector assembly as claimed in claim 5, wherein the spacer includes a first spacer half and a second spacer half, and wherein the through holes, the midfellows, and the notch are defined on both of the first spacer half and the second spacer half.

7. A cable connector assembly comprising:

an insulative housing forming a mating port;

a plurality of contacts disposed in the housing with contacting sections exposed in the mating port;

a cable located behind the housing in a front-to-back direction and including a plurality of wires electrically connected to the corresponding contacts, respectively;

an insulative spacer located around a front region of the cable to regulate the wires, said spacer defining a plurality of through holes in one row, each wire extending through the corresponding through hole, at least a portion of each though hole diametrically larger than the corresponding wire with therebetween a space filled with glues; wherein a plurality of notches are formed in the spacer and located respectively communicatively beside the corresponding through holes transversely so as to allow the glues to fill the space via said notch in a transverse direction perpendicular to said front-to-back direction.

8. The cable connector assembly as claimed in claim 7, wherein said portion is a rear portion of the through hole in said front-to-back direction.

9. The cable connector assembly as claimed in claim 8, wherein a front portion of each through hole is essentially diametrically same with the corresponding wire so as not to allow the glues to flow therethrough and invade a front face of the spacer.

10. The cable connector assembly as claimed in claim 9, wherein the front face of the spacer is recessed to form an avoiding portion so that some through holes not only communicate with an exterior in a vertical direction perpendicular to both said front-to-back direction and said transverse direction but also communicate with each other in a row direction defined along said row.

11. The cable connector assembly as claimed in claim 10, further including a printed circuit board between the housing and the cable, the contacts being soldered upon a front region of the printed circuit board while the wires are soldered upon a rear region of the printed circuit board, and a pair of grounding conductive pads formed on the rear region and spaced from each other in the row direction, wherein the avoiding portion is essentially located between said pair of grounding conductive pads in said row direction.

12. The cable connector assembly as claimed in claim 11, wherein said wires includes single wires and differential pair wires, and said differential pair wires are located by two sides of said single wires, viewed along the front-to-back direction.

13. The cable connector assembly as claimed in claim 7, wherein said transverse direction is same with a direction defined along said row.

14. The cable connector assembly as claimed in claim 11, wherein all the notches are aligned with one another in one row along said transverse direction, and each notch simultaneously communicates with both two neighboring through holes by two sides, viewed in said front-to-back direction.

15. The cable connector assembly as claimed in claim 7, wherein a rear end of the through hole forms a tapered configuration for easing glue entering.

16. A cable connector assembly comprising:

an insulative housing forming a mating port;

a plurality of contacts disposed in the housing with contacting sections exposed in the mating port;

a cable located behind the housing in a front-to-back direction and including a plurality of wires electrically connected to the corresponding contacts, respectively;

an insulative spacer located around a front region of the cable to regulate the wires, said spacer defining a plurality of through holes in one row, each wire extending through the corresponding through hole;

a printed circuit board located between the housing and the cable and defining opposite front and rear regions in the front-to-back direction, the contacts being soldered upon said front region of the printed circuit board, the wires being soldered upon said rear region of the printed circuit board; wherein each though hole forms opposite front and rear portions, and the rear portion is diametrically larger than the corresponding wire with therebetween a space filled with glues while the front portion essentially snugly receives the corresponding wire so as not to allow the glues to invade toward a front face of the spacer; and a pair of grounding conductive pads are formed on the rear region and spaced from each other in the row direction, an avoiding portion is formed within a front face of the spacer and essentially located between said pair of grounding conductive pads in the row direction, and via said avoiding portion some through holes communicate not only with an exterior in a vertical direction perpendicular to both said front-to-back direction and the row direction but also with each other in the row direction.

17. The cable connector assembly as claimed in claim 16, wherein a plurality of notches are formed in the spacer and located respectively communicatively beside the corresponding through holes transversely so as to allow the glues to fill the space via said notch in a transverse direction perpendicular to said front-to-back direction.

18. The cable connector assembly as claimed in claim 17, wherein said transverse direction is same with a row direction defined along said row.

19. The cable connector assembly as claimed in claim 18, wherein each through hole forms an outwardly tapered rear end for easing glue entering.

* * * * *